US009791203B2

(12) United States Patent
Kuehl et al.

(10) Patent No.: US 9,791,203 B2
(45) Date of Patent: Oct. 17, 2017

(54) SECONDARY FLUID INFRASTRUCTURE WITHIN A REFRIGERATOR AND METHOD THEREOF

(75) Inventors: Steven J. Kuehl, Stevensville, MI (US); Tushar Kulkarni, Saint Joseph, MI (US); Guolian Wu, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 2467 days.

(21) Appl. No.: 12/612,211

(22) Filed: Nov. 4, 2009

(65) Prior Publication Data

US 2010/0043455 A1 Feb. 25, 2010

Related U.S. Application Data

(63) Continuation-in-part of application No. 11/770,033, filed on Jun. 28, 2007, now Pat. No. 8,061,153, which
(Continued)

(51) Int. Cl.
*F25D 17/02* (2006.01)
*F25D 11/02* (2006.01)
(Continued)

(52) U.S. Cl.
CPC ..... *F25D 11/025* (2013.01); *F25D 11/006* (2013.01); *F25D 17/02* (2013.01);
(Continued)

(58) Field of Classification Search
CPC ..... F25D 11/025; F25D 11/005; F25D 17/02; F25D 19/006; F25D 2400/16; F25D 2400/28; F25D 2400/30
(Continued)

(56) References Cited

U.S. PATENT DOCUMENTS 2,546,363 A 3/1951 Jaeger
2,641,109 A 6/1953 Muffly
(Continued)

OTHER PUBLICATIONS

European Patent Application No. 08252114.7, filed Jun. 19, 2008, Applicant: Whirlpool Corporation. European Search report dated Dec. 12, 2012.

*Primary Examiner* — Travis Ruby
(74) *Attorney, Agent, or Firm* — Price Heneveld LLP

(57) ABSTRACT

A refrigerator and method of supplying coolant material are provided, the refrigerator including an interior and a main cooling loop, at least a portion of the interior includes a freezer section and at least a portion of the main cooling loop includes an evaporator. The refrigerator includes at least one detachable module having at least one connector, the detachable module configured to removably attach to a surface of the refrigerator, and a secondary cooling loop having at least one connector that corresponds to the at least one detachable module's at least one connector, wherein at least a portion of the secondary cooling loop is in thermal communication with at least one of the main cooling loop, the evaporator, and the freezer section, and wherein the secondary cooling loop is configured to be in fluid communication with the at least one detachable module through the corresponding at least one connectors.

9 Claims, 5 Drawing Sheets

Related U.S. Application Data is a continuation-in-part of application No. 11/646,754, filed on Dec. 28, 2006, which is a continuation-in-part of application No. 11/646,972, filed on Dec. 28, 2006.

(51) Int. Cl.
*F25D 11/00* (2006.01)
*F25D 19/00* (2006.01)

(52) U.S. Cl.
CPC ..... *F25D 19/006* (2013.01); *F25D 2400/16* (2013.01); *F25D 2400/28* (2013.01); *F25D 2400/30* (2013.01)

(58) Field of Classification Search
USPC ..... 62/201, 99, 434, 333, 164, 448
See application file for complete search history.

(56) References Cited

U.S. PATENT DOCUMENTS 3,027,732 A 4/1962 Mann et al.
3,359,751 A 12/1967 Stevens
3,506,325 A 4/1970 Horvay
4,332,429 A 6/1982 Frick et al.
4,354,359 A * 10/1982 Hall et al. ..... 62/299
4,368,622 A 1/1983 Brooks
4,385,075 A 5/1983 Brooks
4,519,216 A * 5/1985 Felicetta ..... 62/185
4,522,114 A 6/1985 Matsuno
4,637,219 A 1/1987 Grose
4,671,074 A 6/1987 Gostelow et al.
4,735,064 A 4/1988 Fischer
4,820,189 A 4/1989 Sergeant et al.
4,864,519 A 9/1989 Appleby et al.
4,910,650 A 3/1990 Goralnik
5,100,213 A 3/1992 Vandarakis et al.
5,225,632 A 7/1993 Gorin et al.
5,467,520 A 11/1995 Nunez et al.
5,485,397 A 1/1996 Yamazato et al.
5,555,189 A 9/1996 Yamazato et al.
5,666,817 A 9/1997 Schulak et al.
5,706,170 A 1/1998 Glovatsky et al.
5,720,185 A 2/1998 Lee
5,722,252 A 3/1998 Kang et al.
5,754,398 A 5/1998 Glovatsky et al.
5,811,732 A 9/1998 Beam
5,816,068 A 10/1998 Oh et al.
5,884,496 A 3/1999 Kim et al.
5,964,101 A 10/1999 Schulak et al.
5,996,370 A 12/1999 Lee
6,065,821 A 5/2000 Anderson et al.
6,067,815 A 5/2000 James
6,073,458 A 6/2000 Kim
6,126,228 A 10/2000 Davis, Jr. et al.
6,230,514 B1 5/2001 Schulak et al.
6,257,897 B1 7/2001 Kubota
6,327,871 B1 12/2001 Rafalovich
6,343,483 B1 2/2002 Armstrong
6,370,908 B1 4/2002 James
6,438,988 B1 8/2002 Paskey
6,463,755 B2 10/2002 Schulak et al.
6,482,340 B1 11/2002 Davis, Jr. et al.
6,813,896 B1 11/2004 Janke et al.
7,093,453 B2 8/2006 Asan et al.
7,096,936 B1 8/2006 Chastine et al.
7,159,413 B2 1/2007 Dail
7,162,878 B2 1/2007 Narayanamurthy et al.
7,228,701 B2 6/2007 Kim
7,260,438 B2 8/2007 Caldwell et al.
7,331,163 B2 2/2008 Hau et al.
7,338,180 B2 3/2008 Wing
7,343,757 B2 3/2008 Egan et al.
7,421,846 B2 9/2008 Narayanamurthy et al.
2005/0126196 A1 6/2005 Grassmuck et al.
2006/0196217 A1 9/2006 Duarte et al.
2007/0074527 A1 4/2007 Lee et al.
2008/0011010 A1 1/2008 Koons et al.
2008/0110198 A1 5/2008 Egan et al.
2008/0115522 A1 5/2008 Kim et al.
2008/0141699 A1* 6/2008 Rafalovich et al. ..... 62/340
2008/0156033 A1 7/2008 Cur et al.
2008/0165478 A1 7/2008 McCoy

* cited by examiner

SECONDARY FLUID INFRASTRUCTURE WITHIN A REFRIGERATOR AND METHOD THEREOF

CROSS-REFERENCE TO RELATED APPLICATION

This application is a continuation-in-part of U.S. patent application Ser. No. 11/770,033 filed on Jun. 28, 2007, by Nihat O. Cur et al., now U.S. Pat. No. 8,061,153, which is a continuation-in-part of U.S. patent application Ser. No. 11/646,754 filed on Dec. 28, 2006, by Nihat O. Cur et al., which is now abandoned, and a continuation-in-part of U.S. patent application Ser. No. 11/646,972 filed on Dec. 28, 2006, by Nihat O. Cur et al., which is now abandoned, the entire disclosures of which are hereby incorporated herein by reference.

FIELD OF THE INVENTION

The present invention generally relates to a refrigerator having a main cooling loop and a secondary cooling loop, and a method thereof, and more particularly, a refrigerator having a main cooling loop and a secondary cooling loop, the secondary cooling loop being configured to be in fluid communication with a detachable module, and a method thereof.

BACKGROUND OF THE INVENTION

Generally, refrigerators are available in many styles, but the most common styles include both a refrigerator compartment and a freezer compartment, which may be side-by-side or one on top of the other. Often, refrigerator features such as ice making, ice crushing, water dispensing, precise temperature and/or humidity control, vacuum packaging, thawing, and fast chilling are available. All of these features typically require some type of utility, such as water, chilled air, or mechanical power to provide the benefit.

Newer concepts in refrigeration have included modular units which fit within a refrigerator compartment in order to provide the advantageous features above. Such modules are themselves can be a great convenience for the users of the refrigerators so equipped, as customers can elect to purchase at the sales floor to have or upgrade their refrigerator with such modules as their lifestyle changes.

SUMMARY OF THE INVENTION

According to one aspect of the present invention, a refrigerator is provided that includes an interior and a main cooling loop, wherein at least a portion of the interior includes a freezer section and at least a portion of the main cooling loop includes an evaporator. The refrigerator further includes at least one detachable module having at least one connector, the detachable module configured to removably attach to a surface of the refrigerator, and a secondary cooling loop having at least one connector that corresponds to the at least one detachable module's at least one connector, wherein at least a portion of the secondary cooling loop is in thermal communication with at least one of the main cooling loop, the evaporator, and the freezer section, and wherein the secondary cooling loop is configured to be in fluid communication with the at least one detachable module through the corresponding at least one connectors.

According to another aspect of the present invention, a refrigerator is provided that has a main cooling loop, wherein at least a portion of the main cooling loop includes an evaporator. The refrigerator further includes at least one detachable module configured to removably attach to a surface of the refrigerator, wherein the at least one detachable module includes at least one quick connect fitting, and a secondary cooling loop including at least one quick connect fitting that corresponds to the at least one detachable module's at least one quick connect fitting, a coolant material, and a tank configured to store the coolant material. The tank is in thermal communication with at least one of the main cooling loop and the evaporator, wherein the secondary cooling loop is configured to be in fluid communication with the at least one detachable module by supplying the coolant material through the corresponding at least one quick connect fittings, and wherein the coolant material of the secondary cooling loop is independent from coolant material of the main cooling loop.

According to yet another aspect of the present invention, a method of supplying coolant material in a refrigerator is provided, the method includes the steps of providing a main cooling loop having a coolant material and a secondary cooling loop having a coolant material, the coolant material of the secondary cooling loop being independent from the coolant material of the main cooling loop, providing at least one detachable module configured to be connected to the secondary cooling loop by an at least one connector, reducing a temperature of the coolant material, and supplying the coolant material from the secondary cooling loop to the at least one detachable module through the at least one connector.

These and other aspects, objects, and features of the present invention will be understood and appreciated by those skilled in the art upon studying the following specification, claims, and appended drawings.

DETAILED DESCRIPTION

For purposes of description herein, the terms "upper," "lower," "right," "left," "rear," "front," "vertical," "horizontal," and derivatives thereof shall relate a refrigerator including a secondary cooling loop, and a method thereof. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
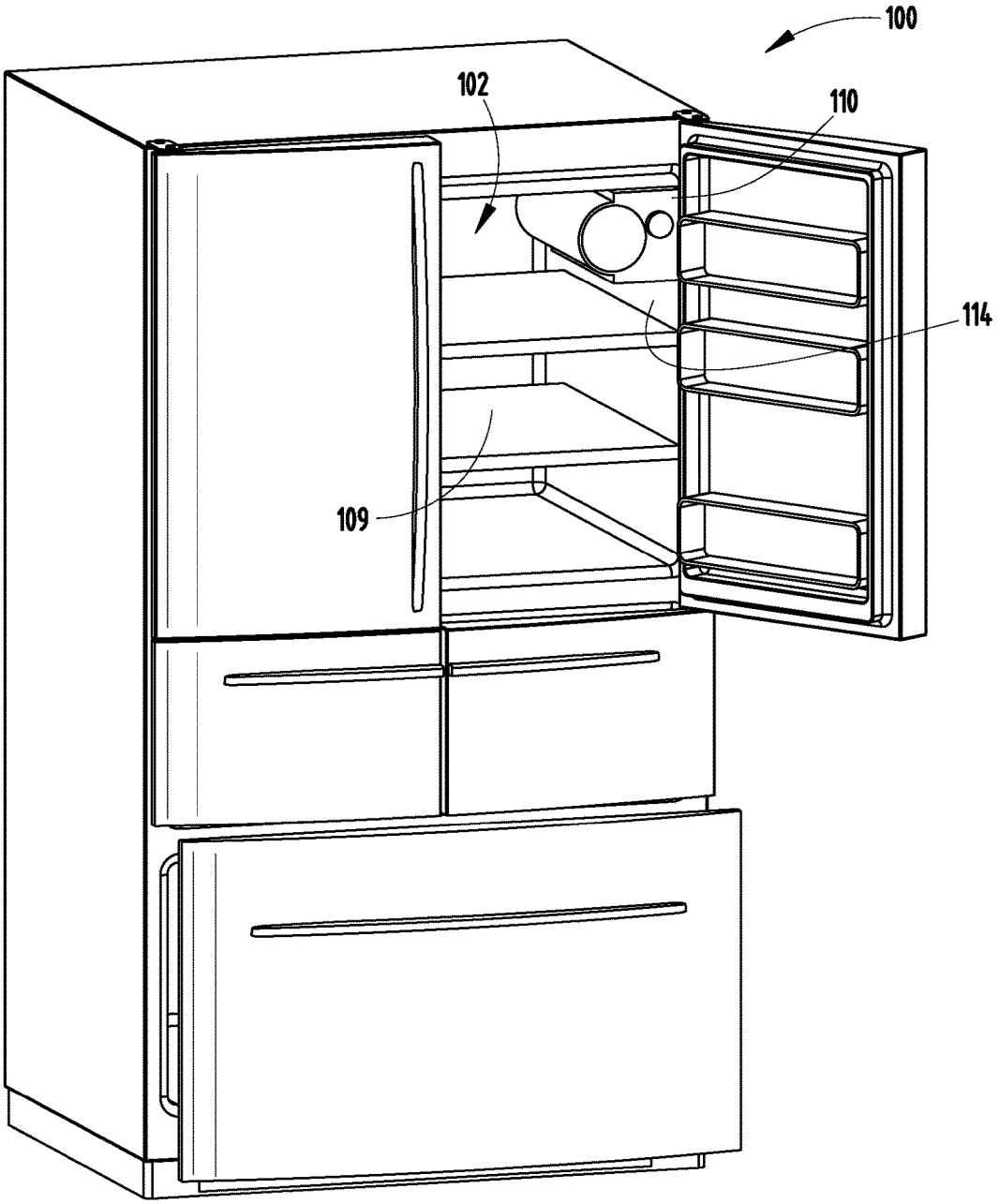
FIG. 1 is a perspective view of a refrigerator, in accordance with one embodiment of the present invention.
Figure 2:
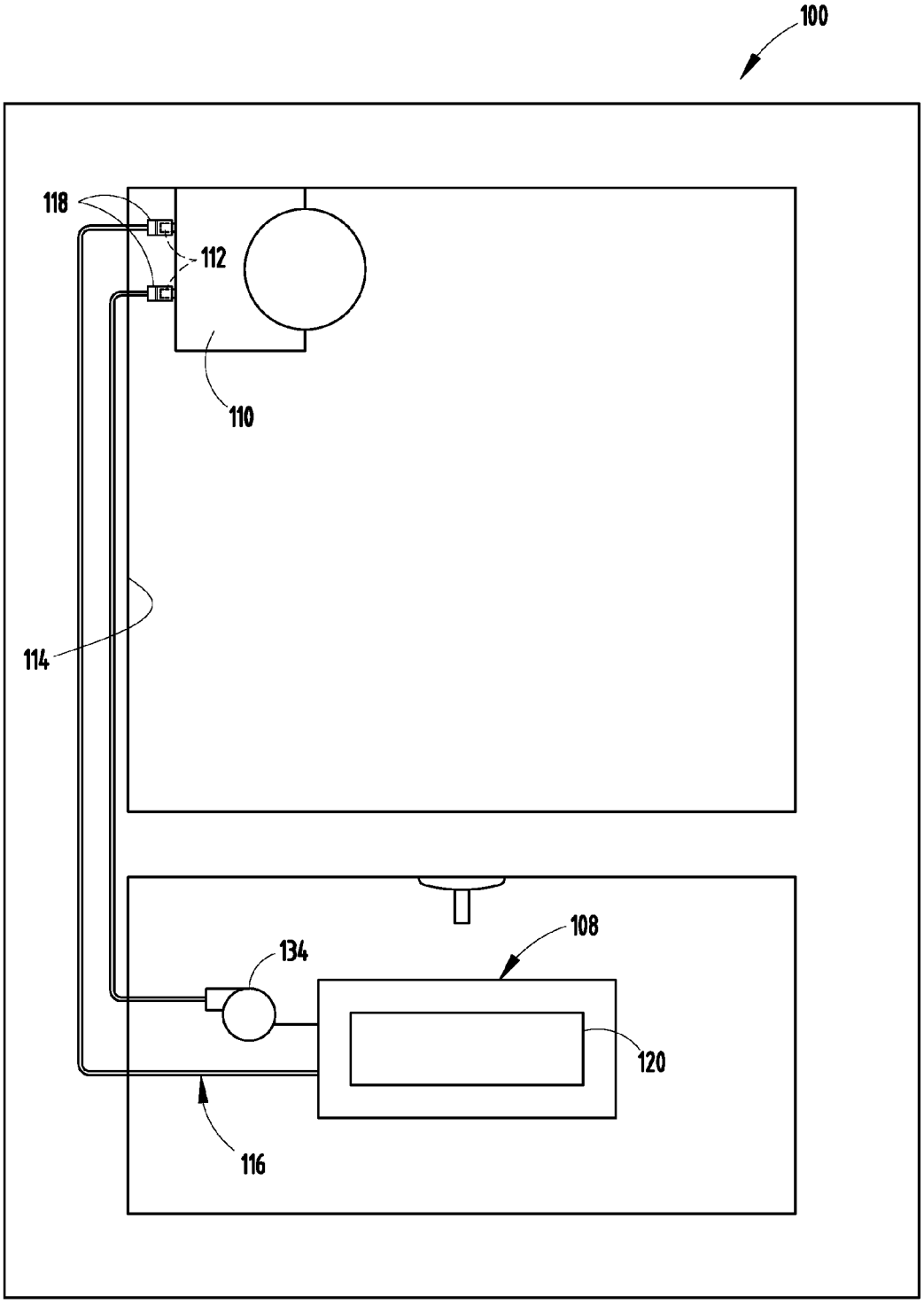
FIG. 2 is a schematic diagram of a refrigerator, in accordance with one embodiment of the present invention.
Figure 3:
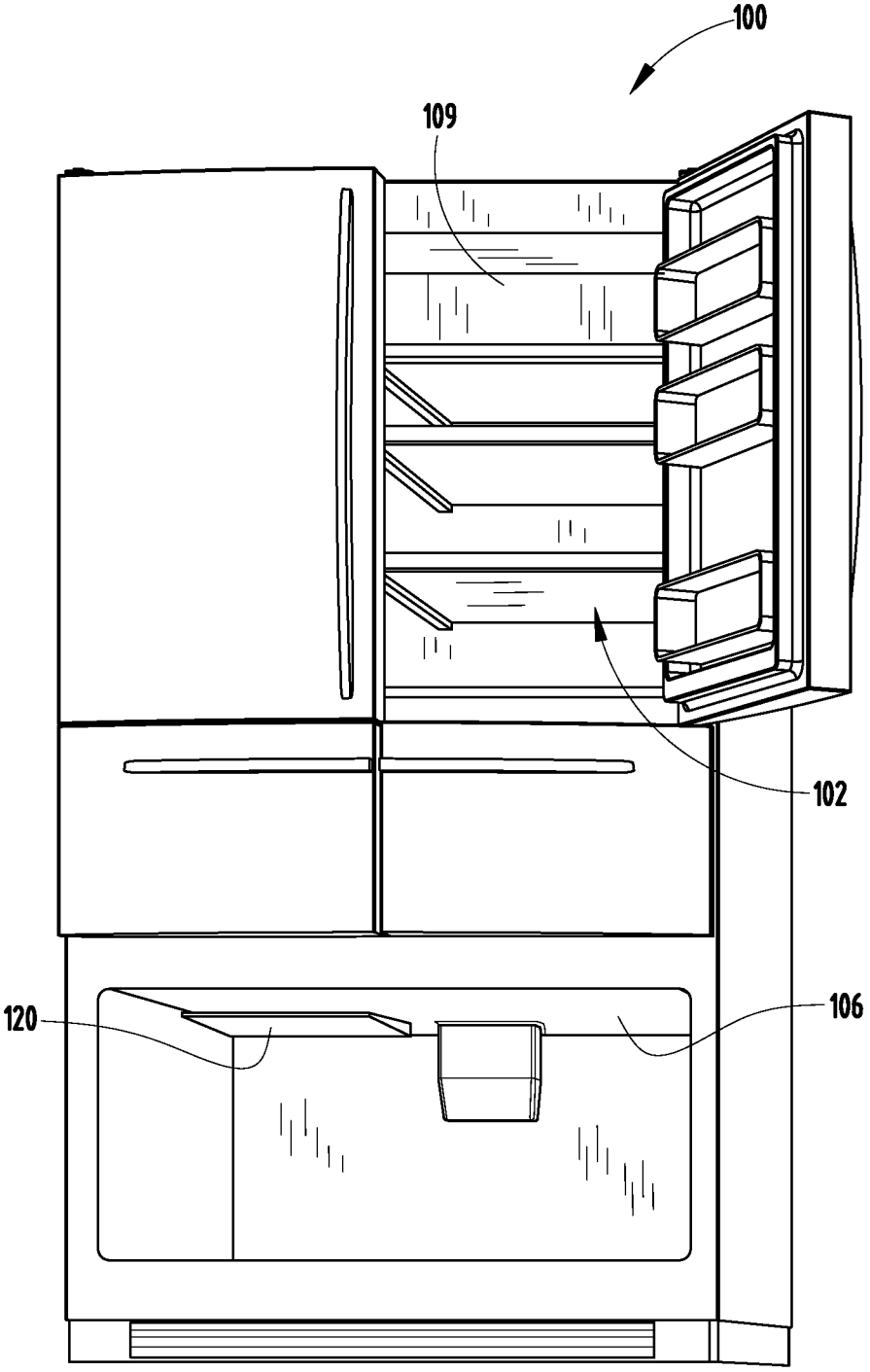
FIG. 3 is a perspective view of a refrigerator, in accordance with one embodiment of the present invention.

With respect to FIGS. 1-7B, a refrigerator is generally shown in FIGS. 1-3 at reference identifier 100. The refrigerator 100 can have an interior, generally indicated at reference identifier 102, and a main cooling loop, generally indicated at reference identifier 104 (FIGS. 4-7B). At least a portion of the interior 102 can include a freezer section 106 (FIG. 3), and at least a portion of the main cooling loop 104 can include an evaporator, generally indicated at reference identifier 108 (FIGS. 2 and 4-7B). According to one embodiment, the refrigerator 100 can include the freezer section 106 (FIG. 3), a refrigerator section 109 (FIGS. 1 and 3), or a combination thereof (FIG. 3).

The refrigerator 100 can include at least one detachable module 110 that includes at least one connector 112 (FIG. 2), wherein the detachable module 110 is configured to removably attach to a surface 114 of the refrigerator 100. Additionally, the refrigerator 100 can include a secondary cooling loop, generally indicated at 116, that includes at least one connector 118 that corresponds to the detachable module's 110 connector 112, wherein at least a portion of secondary cooling loop 116 is in thermal communication with the main cooling loop 104, the evaporator 108, the freezer section 106, or a combination thereof. The secondary cooling loop 116 can further be configured to be in fluid communication with the detachable module 110 through the corresponding connectors 112, 118, as described in greater detail herein.

By way of explanation and not limitation, the refrigerator 100 can include an infrastructure for the main cooling loop 104, in addition to at least a portion of the infrastructure for the secondary cooling loop 116 at the time the refrigerator 100 is manufactured and provided to a consumer. The detachable module 110 can be configured to then connect to the secondary cooling loop 116 after manufacturing is complete, such that the detachable module 110 provides a function, after the manufacturing process is complete, that may not otherwise be available by other components of the refrigerator 100. Additionally or alternatively, the detachable module 110 can provide an enhanced feature, which is otherwise provided by the refrigerator 100, additional capacity to a function otherwise provided by the refrigerator 100, or a combination thereof. However, it should be appreciated by those skilled in the art that one or more components that are included in the secondary cooling loop 116, connected to the secondary cooling loop 116, or a combination thereof, can be connected during the manufacturing process. Therefore, at least a portion of the secondary cooling loop 116 is provided in the refrigerator 100 infrastructure at the time of manufacturing the refrigerator 100, such that the refrigerator 100 is configured to operate one or more detachable modules 110 post consumer purchase, if so desired with reduced invasiveness to the refrigerator 100 infrastructure.

The corresponding at least one connectors 112, 118 can be corresponding quick connect fittings, according to one embodiment. Typically, a quick connect fitting can be a fitting that attaches quickly and efficiently and with minimal leakage (e.g., fluid leakage, gas leakage, the like, or a combination thereof). Additionally or alternatively, the corresponding connectors 112, 118 can be configured to further include a gaseous connection, an electrical power connection, a data connection, the like, or a combination thereof.

According to one embodiment, a coolant material (e.g., FIG. 7A) is contained in the secondary cooling loop 116, wherein a temperature of the coolant material is reduced as a function of the secondary cooling loop 116 being in thermal communication with the main cooling loop 104, the evaporator 108, the freezer section 106, or a combination thereof. Typically, the secondary cooling loop 116 includes a tank 120 that is configured to store a portion of the coolant material. The tank 120 can be configured to be included in the refrigerator 100 during the manufacturing process or configured to be attached and connected to the secondary cooling loop 116 after the manufacturing process is complete, as described in greater detail below. The tank 120 can be a heat exchanger, according to one embodiment.

For purposes of explanation and not limitation, the thermal communication of at least a portion of the secondary cooling loop 116 and the main cooling loop 104, the evaporator 108, which can form part of the main cooling loop 104, the freezer section 106, or a combination thereof, can include the secondary cooling loop 116 being located proximate the evaporator 108 (FIG. 4), located adjacently to the evaporator 108 (FIG. 5), integrated with the evaporator 108 (FIG. 6), configured to have at least a portion of the main cooling loop 104 pass through an interior of the tank 120 (FIGS. 7A and 7B), at least partially located within the freezer section 106 (FIG. 3), the like, or a combination thereof. Thus, the thermal communication can be a function of at least a portion of the secondary cooling loop 116 being in sufficient proximity to a component that can be configured to reduce the coolant material of the secondary cooling loop 116. Typically, such thermal communication is between the tank 120 of the secondary cooling loop 116 and the main cooling loop 104, the evaporator 108, the freezer section 106, or a combination thereof. However, it should be appreciated by those skilled in the art that in embodiments that include and do not include the tank 120, the thermal communication between such components can be with additional or alternative portions of the secondary cooling loop 116.

Figure 4:
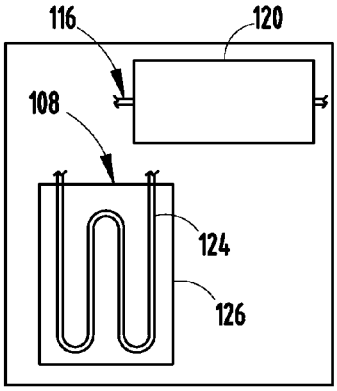
FIG. 4 is a schematic diagram of a main cooling loop in thermal communication with a secondary cooling loop, in accordance with one embodiment of the present invention.
Figure 5:
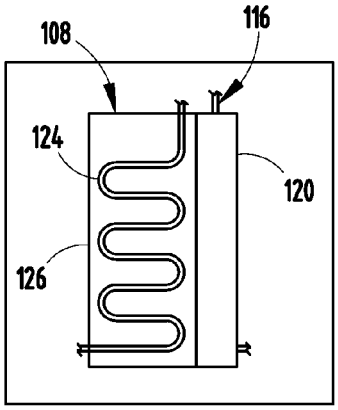
FIG. 5 is a schematic diagram of a main cooling loop in thermal communication with a secondary cooling loop, in accordance with one embodiment of the present invention.
Figure 6:
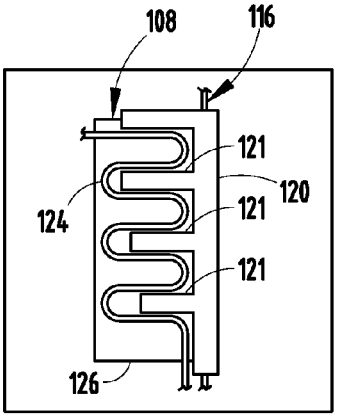
FIG. 6 is a schematic diagram of a main cooling loop in thermal communication with a secondary cooling loop, in accordance with one embodiment of the present invention.

By way of explanation and not limitation, the embodiments described in FIGS. 4-6 are described with respect to the tank 120 of the secondary cooling loop 116 being in thermal communication with the evaporator 108 of the main cooling loop 104 for exemplary purposes, and such a description of thermal communication between the main cooling loop 104 and the secondary cooling loop 116 is not limited to these alignments. According to one embodiment as illustrated in FIG. 4, the tank 120 is proximate the evaporator 108, such that there is thermal communication between the evaporator 108 and the secondary cooling loop 116 to reduce the temperature of the coolant material within the tank 120. In such an embodiment, the proximate location between a secondary cooling loop 116 and the evaporator 108 can include an air gap between the evaporator 108 and the secondary cooling loop 116 (e.g., no surface-to-surface contact between the tank 120 and the evaporator 108), while maintaining adequate thermal communication to reduce the temperature of the coolant material in the tank 120.

According to an alternate embodiment, as illustrated in FIG. 5, the tank 120 can be adjacent the evaporator 108. In such an embodiment, an adjacent alignment between the evaporator 108 and the secondary cooling loop 116 typically results in at least a portion of a surface of the evaporator 108 contacting at least a portion of a surface of the tank 120; however, it should be appreciated by those skilled in the art that an air gap can be present between the evaporator 108 and the secondary cooling loop 116 in such an adjacent position. When an air gap is present in such an adjacent position, the air gap between the evaporator 108 and the tank 120 is greater in an above-described proximate embodiment (FIG. 4), as compared to an air gap of an adjacent embodiment (FIG. 5). Typically, an adjacent position between the evaporator 108 and the tank 120 (FIG. 5) can result in an increase in efficiency of the thermal communication when compared to a proximate position between the evaporator 108 and the tank 120, as illustrated in FIG. 4.

In one or more embodiments that include the tank 120, such as, but not limited to, embodiments illustrated in FIGS. 4 and 5, the tank 120 can be configured to be removably connected to a proximate or adjacent position with respect to the evaporator 108, respectively. The tank 120 can be removably connected to the evaporator 108 using any suitable removable attachment device, such as, but not limited to, fasteners, corresponding hooks and indentations or flanges, a nut and bolt combination, other suitable mechanical attachment devices, the like, or a combination thereof. According to an alternate embodiment, the tank 120 is not removably connected with the refrigerator 100, such that the tank 120 is part of the secondary cooling loop 116 that is included in the refrigerator 100 at the time of manufacture.

Yet another alternative embodiment, as illustrated in FIG. 6, the tank 120 can be integrated with the evaporator 108. Typically, the tank 120 includes one or more appendages 121 extending from a surface of the tank 120, wherein the appendages 121 integrate with one or more coils 124, a housing 126 of the evaporator 108, the like, or a combination thereof. In such an embodiment, integration between the tank 120 and the evaporator 108 can result in an increase in surface-to-surface contact between the evaporator 108 and the tank 120, which can result in an increase in efficiency of the thermal communication between the evaporator 108 and the tank 120, as compared to an embodiment that does not include such an integration.

In an embodiment, as illustrated in FIG. 6, the tank 120 is typically integrated with the evaporator 108 at the time the refrigerator 100 is manufactured. However, it should be appreciated by those skilled in the art that the evaporator 108 and the tank 120 can be configured so that integration between the evaporator 108 and the tank 120 can be made during a post manufacture attachment. Further, in any of the embodiments described herein, the housing 126 of the evaporator 108 can be removably attached, so that other components of the evaporator 108 are accessible for thermal communication with the secondary cooling loop 116.

According to an alternate integration embodiment, a portion of the secondary cooling loop 116 can pass between coils 124 of the evaporator 108. Typically, in such an embodiment, one or more tubular portions of the secondary cooling loop 116 are integrated with the evaporator 108, so that the tubular portions of the secondary cooling loop 116 pass adjacent to the one or more coils 124. The portion of the secondary cooling loop 116 can contact the coils 124 of the evaporator 108 or have an air gap between the secondary cooling loop 116 and the coils 124. Such an integration between the secondary cooling loop 116 and the evaporator 108 can result in an increase in efficiency of the thermal communication between the secondary cooling loop 116 and the evaporator 108 when compared to the tank 120 being proximate the evaporator 108 and the tank 120 being adjacent the evaporator 108.

Additionally or alternatively, a portion of the secondary cooling loop 116, such as, but not limited to, the tank 120 can be located in the freezer section 106 (FIG. 3). In such an embodiment, the coolant material contained in the tank 120 is cooled by being in thermal communication with the freezer section 106. Thus, the coolant material in the secondary cooling loop 116 is cooled in a similar manner as other items which are typically stored in a freezer section 106 (e.g., food products, beverages, etc.).

For purposes of explanation and not limitation, the above-described embodiments, as exemplarily illustrated in FIGS. 3-6, can result in the coolant material of the secondary cooling loop 116 being cooled to different temperatures. Assuming that the coolant material and other components of the main cooling loop 104 are approximately the same in all exemplary scenarios, when the tank 120 is located in the freezer section 106, the coolant material of the secondary cooling loop 116 can obtain a temperature of the freezer section 106, which is typically zero degrees Fahrenheit (0° F.) or greater. When the tank 120 of the secondary cooling loop 116 is adjacent or proximate the evaporator 108, the coolant material of the secondary cooling loop 116 can have a temperature that can be driven in at least part by a temperature of the evaporator coils 124, and thus, can typically range between negative ten degrees Fahrenheit (−10° F.) and zero degrees Fahrenheit (0° F.). In an embodiment where the tank 120 of the secondary cooling loop 116 is integrated with the evaporator 108, the coolant material of the secondary cooling loop 116 can have a temperature that can be slightly warmer than a temperature of the evaporator coils 124, and thus, be in a range of negative fifteen degrees Fahrenheit (−15° F.) or below. These exemplary temperatures can be actual temperatures of the coolant material of the secondary cooling loop 116 or relative temperatures with respect to the different exemplary scenarios. Thus, this proportion of temperatures depending upon the thermal communication between the secondary cooling loop 116 and the evaporator 108 generally illustrates a difference in thermal communication efficiency between these exemplary embodiments, which can result in specific levels of cooling capacity of the second cooling loop 116.

Figure 7A:
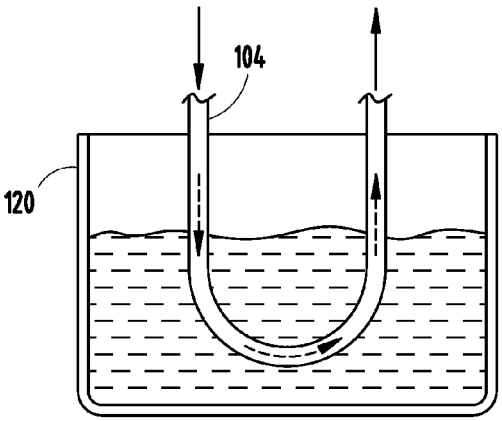
FIG. 7A is a schematic diagram of a main cooling loop in thermal communication with a secondary cooling loop, in accordance with one embodiment of the present invention.
Figure 7B:
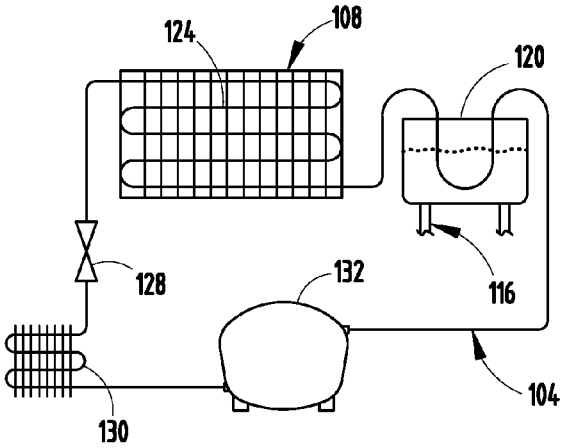
FIG. 7B is a schematic diagram of a main cooling loop in thermal communication with a secondary cooling loop, in accordance with one embodiment of the present invention.

According to one embodiment, as illustrated in FIGS. 7A and 7B, a portion of the main cooling loop 104 extends through the tank 120. In such an embodiment, the thermal communication between the main cooling loop 104 and the secondary cooling loop 116 is between a portion of the main cooling loop 104 that contacts the coolant material in the tank 120. Typically, the main cooling loop 104 contacting the coolant material in the tank 120, as illustrated in FIGS. 7A and 7B, results in an increase in efficiency of thermal communication between the main cooling loop 104 and the secondary cooling loop 116 when compared to a proximate location (e.g., FIG. 4) or an adjacent location (e.g., FIG. 5) of the tank 120 with respect to the main cooling loop 104. In some scenarios, the main cooling loop 104 contacting the coolant material in the tank 120 as illustrated in FIGS. 7A and 7B, can have an increase in efficiency in the thermal communication as compared to an embodiment where the tank 120 is integrated with the evaporator 108 (FIG. 6). It should be appreciated by those skilled in the art, that an embodiment, wherein a portion of the main cooling loop 104 extends through the secondary cooling loop 116, such as the tank 120, another portion of the secondary cooling loop 116 can be in thermal communication with the evaporator 108 (FIGS. 4-6), freezer section 106 (FIG. 3), or a combination thereof.

According to one embodiment, as illustrated in FIG. 7B, a portion of the main cooling loop 104 that contacts the coolant material in the tank can be a portion of the main cooling loop 104 that is exiting the evaporator 108, entering the evaporator 108, other portions of the main cooling loop 104 on a high pressure portion or a low pressure portion of the main cooling loop 104, or a combination thereof. The main cooling loop 104, as illustrated in FIG. 7B, can include the evaporator 108, a throttling device 128, a condenser 130, a compressor 132, and a portion extending through the tank 120.

Additionally or alternatively, the secondary cooling loop 116 can include a pump 134 configured to supply the coolant material of the secondary cooling loop 116 to the detachable module 110 through the corresponding connectors 112, 118. Exemplary connectors are disclosed in U.S. patent application Ser. No. 12/539,651 entitled "PARK PLACE REFRIGERATION MODULE UTILITIES ENABLED VIA CONNECTION," now U.S. Pat. No. 8,299,656 and U.S. Patent Application Publication No. 2009/0229298 entitled "REFRIGERATOR WITH MODULE RECEIVING CONDUITS," now U.S. Pat. No. 8,117,865, wherein these references are hereby incorporated herein by reference in their entirety. The pump 134 is illustrated in FIG. 2 at an exemplary location in the secondary cooling loop 116, and it should be appreciated by those skilled in the art that the pump 134 can be positioned in other locations of the secondary cooling loop 116, such as, but not limited to, the detachable module 110, the tank 120, or the like. Typically, the coolant material of the secondary cooling loop 116 is independent from the coolant material of the main cooling loop 104, such that the main cooling loop 104 is in thermal communication with the secondary cooling loop 116, but the coolant materials of the main cooling loop 104 and secondary cooling loop 116 are not inter-mixed.

According to one embodiment, the detachable module 110 includes a plurality of detachable modules 110, at least a portion of the plurality of detachable modules 110 utilizing a coolant material for different applications. For purposes of explanation and not limitation, the different applications can include a turbo chill module (e.g., for chilling various standard beverage containers), a fast freeze module, a shock freeze module, a temperature controlled crisper compartment module, a fresh food compartment module, an ice making module, a heat exchanger module for dispensing cold or chilled water, a heat exchanger module for creating cold or chilled water to facilitate its carbonation and dispensing a carbonated beverage, an air-less cooling module, the like, or a combination thereof.

Figure 8:
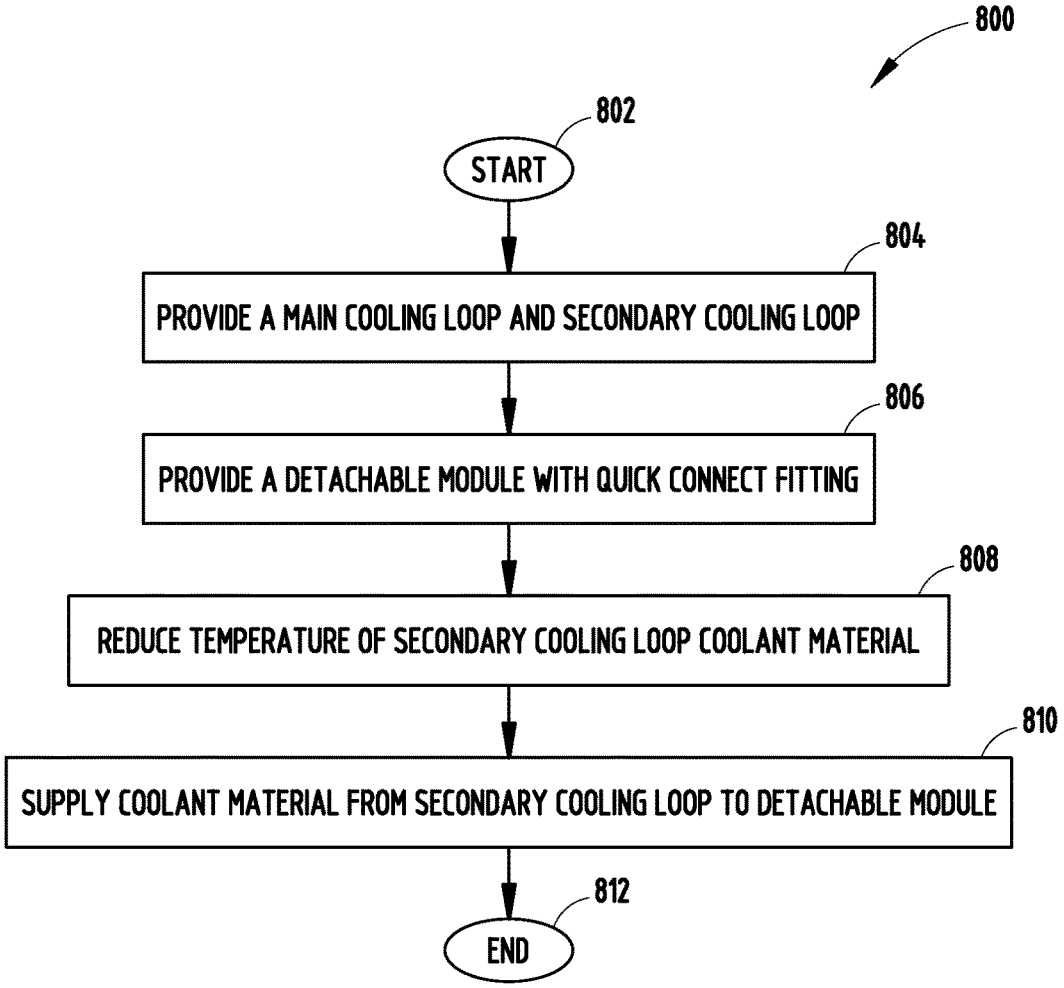
FIG. 8 is a flowchart illustrating a method of supplying coolant material in a secondary cooling loop of a refrigerator to a detachable module, in accordance with one embodiment of the present invention.

With respect to FIGS. 1-8, a method of supplying coolant material in a refrigerator 100 to a detachable module 110 is generally shown in FIG. 8 at reference identifier 800. The method 800 starts at step 802, and proceeds to step 804, wherein a main cooling loop 104 is provided that includes a coolant material, and a secondary cooling loop 116 is provided that includes a coolant material, wherein the coolant material of the secondary cooling loop 116 is independent from the coolant material of the main cooling loop 104.

The method 800 then proceeds to step 806, wherein the detachable module 110 is provided, and configured to be connected to the secondary cooling loop 116 by the connectors 112, 118. At step 808, a temperature of the coolant material is reduced. The coolant material of the secondary cooling loop 116 can be reduced by the secondary cooling loop 116 being in thermal communication with one of the main cooling loop 104, the evaporator 108, the freezer section 106, or a combination thereof, as described herein. The method 800 then proceeds to step 810, wherein the coolant material from the secondary cooling loop 116 can be supplied to the detachable module 110 through the connectors 112, 118, and the method 800 can then end at step 812.

Advantageously, the refrigerator 100 having at least a portion of the secondary cooling loop 116 included in the refrigerator's 100 infrastructure at the time of manufacturing and method thereof can provide a way for detachable modules 110 to be fluidly connected to the secondary cooling loop 116 through a connector 118, to provide additional and/or different features to the refrigerator 100 post manufacturing. Thus, a consumer can purchase the refrigerator 100 and later have the detachable modules 110 to add or supplement features of the refrigerator 100 so as to not have to purchase a new refrigerator 100, while such detachable modules 110 can be added with reduced invasion into the structural elements of the refrigerator 100 as compared to a refrigerator 100 that does not include the secondary cooling loop 116 infrastructure at the time of manufacture. It should be appreciated by those skilled in the art that additional or alternative advantages may be present from the refrigerator 100 and method 800. It should further be appreciated by those skilled in the art that the above-described components can be combined in additional or alternative combinations.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. A refrigerator having a main cooling loop, at least a portion of the main cooling loop including an evaporator, said refrigerator comprising:

at least one detachable module configured to removably attach to a surface of the refrigerator, and comprising:

at least one quick connect fitting; and a secondary cooling loop comprising:

at least one quick connect fitting that corresponds to said at least one detachable module's said at least one quick connect fitting;

a coolant material; and a selectively removable tank configured to store said coolant material, wherein said selectively removable tank is integrated with and in thermal communication with the evaporator, wherein said secondary cooling loop is configured to be in fluid communication with said at least one detachable module by supplying said coolant material through said corresponding at least one quick connect fittings, and wherein said coolant material of said secondary cooling loop is independent from the coolant material of the main cooling loop, and wherein said selectively removable tank includes at least one protrusion, and wherein the evaporator includes at least one coil that is configured to receive the at least one protrusion of the selectively removable tank such that the selectively removable tank is integrated with the evaporator.

2. The refrigerator claim 1, wherein a temperature of said coolant material is reduced as a function of said selectively removable tank being in thermal communication with the evaporator.

3. The refrigerator of claim 1, wherein said selectively removable tank includes a plurality of protrusions, and wherein the evaporator includes a plurality of coils that are configured to receive the plurality of protrusions of the selectively removable tank such that the selectively removable tank is integrated with the evaporator.

4. The refrigerator of claim 1, wherein said selectively removable tank is configured to be removably connected to the evaporator.

5. The refrigerator of claim 1, wherein said secondary cooling loop comprises a pump configured to supply said coolant material to said at least one detachable module through said corresponding at least one quick connect fittings.

6. The refrigerator of claim 1, wherein said at least one detachable module comprises a plurality of detachable modules, at least a portion of said plurality of detachable modules utilizing said coolant material for different applications, and comprising at least one of:

a turbochill module;

a fast freeze module;

a shock freeze module;

a temperature controlled crisper compartment module;

a RC cooling module;

an ice making module;

a heat exchanger module for dispensing cold or chilled water;

a heat exchanger module for creating cold or chilled water to facilitate its carbonation and dispense a carbonated beverage; and an air-less cooling module.

7. A method of supplying coolant material in a refrigerator, said method comprising the steps of:

providing a main cooling loop comprising the coolant material and a secondary cooling loop comprising the coolant material, said coolant material of said secondary cooling loop being independent from said coolant material of said main cooling loop;

providing at least one detachable module configured to be connected to said secondary cooling loop by an at least one quick connect fitting;

providing a selectively removable tank configured to store said coolant material;

reducing a temperature of said coolant material; and supplying said coolant material from said secondary cooling loop to said at least one detachable module through said at least one quick connect fitting, wherein said selectively removable tank includes at least one protrusion, and wherein an evaporator includes at least one coil that is configured to receive the at least one protrusion of the selectively removable tank.

8. The method of claim 7, wherein said step of reducing a temperature of said coolant material further comprises at least one of:

integrating at least a portion of said selectively removable tank of the secondary cooling loop into said evaporator; and locating at least a portion of a heat exchange portion of the selectively removable tank into a freezer section of the refrigerator.

9. The method of claim 8, wherein said integration has an increase in thermal communication efficiency with respect to said freezer section location.

* * * * *